US011540619B2

(12) United States Patent
Berhault

(10) Patent No.: US 11,540,619 B2
(45) Date of Patent: Jan. 3, 2023

(54) APPLICATOR FOR THE EYELASHES OR EYEBROWS

(71) Applicant: L'OREAL, Paris (FR)

(72) Inventor: Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 357 days.

(21) Appl. No.: 16/318,008

(22) PCT Filed: Jul. 31, 2017

(86) PCT No.: PCT/EP2017/069359
§ 371 (c)(1),
(2) Date: Jan. 15, 2019

(87) PCT Pub. No.: WO2018/024691
PCT Pub. Date: Feb. 8, 2018

(65) Prior Publication Data

US 2019/0298050 A1 Oct. 3, 2019

(30) Foreign Application Priority Data

Aug. 4, 2016 (FR) ..... 1657570

(51) Int. Cl.
*A46B 9/02* (2006.01)
*A45D 40/26* (2006.01)
*A46B 3/18* (2006.01)

(52) U.S. Cl.
CPC ..... *A46B 9/021* (2013.01); *A45D 40/265* (2013.01); *A46B 3/18* (2013.01); *A46B 2200/106* (2013.01); *A46B 2200/1053* (2013.01)

(58) Field of Classification Search
CPC .. A45D 40/262; A45D 40/264; A45D 40/265; A45D 40/267; A45D 34/042;
(Continued)

(56) References Cited

U.S. PATENT DOCUMENTS

2010/0089415 A1* 4/2010 Vandromme ..... A46B 9/021 132/218
2011/0284021 A1* 11/2011 Gueret ..... A45D 40/24 132/218
(Continued)

FOREIGN PATENT DOCUMENTS

FR 2916328 A1 * 11/2008 ..... A46B 9/021
FR 2958130 A1 10/2011
(Continued)

OTHER PUBLICATIONS

International Search Report dated Sep. 1, 2017, in PCT/EP2017/069359, filed Jul. 31, 2017.
(Continued)

*Primary Examiner* — Jacqueline T Johanas
*Assistant Examiner* — Sarah Woodhouse
(74) *Attorney, Agent, or Firm* — Oblon, McClelland, Maier & Neustadt, L.L.P.

(57) ABSTRACT

The present invention relates to an applicator for applying a cosmetic product to the eyelashes and/or eyebrows, having an applicator member (8) having: —a core of thermoplastic material having a longitudinal axis, the core being twisted through more than one revolution about its longitudinal axis under the effect of the twist of the metal arms of the holder, and having an endpiece that has no spikes. —spikes of thermoplastic material extending from the core, —a holder having two metal arms twisted around the core.

17 Claims, 2 Drawing Sheets

Figure 1:
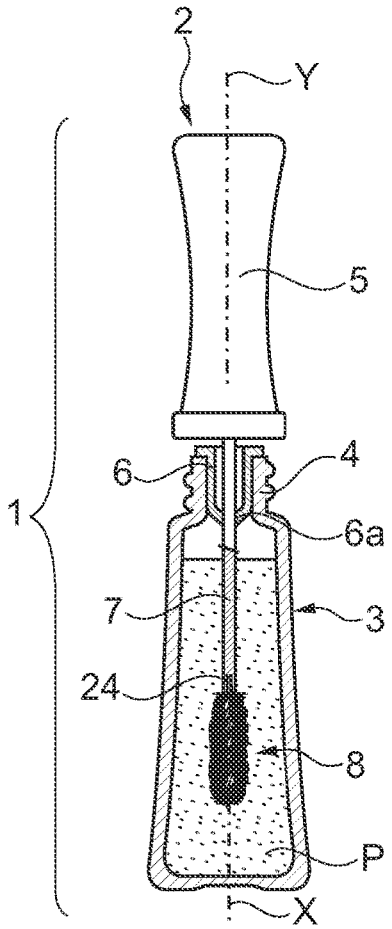

(58) Field of Classification Search
CPC .. A45D 34/043; A45D 34/045; A45D 34/046; A46B 3/18; A46B 2200/1046; A46B 2200/1053; A46B 2200/106; A46B 9/021; A46B 9/025; A46B 9/028
USPC ..... 132/216, 218, 313, 317
See application file for complete search history.

(56) References Cited

U.S. PATENT DOCUMENTS

| | | | | |
|---|---|---|---|---|
| 2012/0148328 | A1 | 6/2012 | Jollet | |
| 2013/0104925 | A1* | 5/2013 | Caulier | A46B 9/021 132/218 |
| 2013/0195539 | A1* | 8/2013 | Fontaine | A46B 3/18 401/129 |

FOREIGN PATENT DOCUMENTS

| | | | | |
|---|---|---|---|---|
| FR | 2996109 | A1 | 4/2014 | |
| FR | 3028396 | A1 * | 5/2016 | A45D 40/267 |
| FR | 3028396 | A1 | 5/2016 | |
| WO | 2006/090343 | A1 | 8/2006 | |
| WO | WO 2014/054001 | A1 | 4/2014 | |
| WO | WO 2016/075282 | A1 | 5/2016 | |

OTHER PUBLICATIONS

French Preliminary Search Report dated Jan. 30, 2017, in FR 1657570, filed Aug. 4, 2016.

* cited by examiner

APPLICATOR FOR THE EYELASHES OR EYEBROWS

The present invention relates to applicators for applying a cosmetic, makeup or care, product to the eyelashes or eyebrows, to packaging and application devices having such applicators and to methods for manufacturing such applicators.

Applicators are known that have an applicator member constituted by a core molded with spikes from a thermoplastic material.

Also known are brushes with a twisted core, having two metal arms that enclose bristles between one another.

Applicators known as hybrid applicators having a core of thermoplastic material, bearing spikes, and metal arms which enclose the core and are twisted thereon, imparting torsion on the core and causing the spikes to form helical layers, have also been proposed. The applications US 2012/0148328 A1 and FR3028396 disclose such applicators.

There is a need to further improve hybrid applicators having a core of thermoplastic material, spikes molded with the core, and a holder having two metal arms twisted on the core in order to cause the latter to turn about its longitudinal axis such that the spikes follow a helical trajectory.

Therefore, the subject of the invention is an applicator for applying a cosmetic product to the eyelashes and/or eyebrows, having an applicator member having:

- a core of thermoplastic material having a longitudinal axis,
- spikes of thermoplastic material extending from the core,
- a holder having at least two metal arms twisted around the core, the core having at least one end piece that extends along the longitudinal axis of the core and does not have spikes.

The presence of the end piece makes it easier to hold the core/spikes assembly by way of the end piece and to orient same before the metal arms are fitted and twisted. Proper orientation of the core/spikes assembly makes it easier to fit the metal arms without damaging the spikes. It is easier to manufacture the applicator as a result.

A "spike" denotes an individual projecting element.

Preferably, the end piece forms a proximal end part of the core.

Preferably, the end piece has a length $l_e$ of between 1 and 7 mm.

Preferably, the ratio $l_e/l_q$ of the length of the end piece to the length of the tail of the applicator member formed by the proximal part thereof that does not have spikes is between 0.1 and 0.8.

Preferably, the holder extends along the entire length L of the core.

Preferably, the applicator has a stem in which the holder and the end piece are inserted, the end piece preferably being inserted entirely in the stem. The holder and the end piece may be fixed analogously to the fixing of the twisted cores of conventional mascara brushes, by hot insertion of the holder and the end piece in a recess of the stem.

The spikes are preferably molded together with the core, notably from the same material.

In a variant, the spikes are overmolded or formed by two-shot injection molding on the core.

The spikes may extend along the core in the form of longitudinal rows, preferably rectilinear rows.

The spikes may be flocked.

The end piece may have a cross section that is not circular, notably cruciform, in particular in the form of a "+". The metal arms may be fitted in the end piece, along grooves formed therein on account of its cruciform cross section. The overall diameter of the assembly formed by the end piece provided with the metal arms may be defined by these arms situated opposite one another on the end piece.

Preferably, the end piece is twisted under the effect of the twist of the arms of the holder.

The end piece is preferably molded together with the core, notably from the same material.

In a variant, the end piece is overmolded or formed by two-shot injection molding on the core.

In a variant, the arms are inscribed entirely in the cross section of the end piece, and the overall diameter of the assembly of end piece and metal arms is defined by the end piece.

Preferably, the overall diameter k of the assembly formed by the end piece provided with the metal arms is between 1.5 and 4 mm.

The overall diameter of the assembly formed by the end piece provided with the metal arms may be between 4 mm and 12 mm.

Preferably, the core has, preferably along substantially its entire length L and in particular over the end piece, a plurality of ribs that define grooves between one another, the metal arms of the holder being received in these grooves. The ribs extend preferably along substantially the entire length of the core and in particular over the end piece. The ribs may have a height greater than or equal to 0.8 mm. The ribs may give the longitudinal section of the core a cruciform shape.

Preferably, each of the metal arms extends along the entire length of a groove.

Preferably, the spikes extend from the ribs of the core. The number of rows of spikes may be equal to the number of ribs.

Preferably, the core is twisted through more than one revolution, notably through more than two revolutions, about its longitudinal axis from one end of the applicator member to the other, under the effect of the twist of the arms of the support. The thermoplastic material of the core is advantageously an elastomer, so as to allow such a rotation without damaging the core.

At least some of the spikes may be multiple spikes, notably double spikes. This allows a denser distribution of the free ends of the spikes, more akin to the distribution of the bristles of conventional brushes with a twisted core, and in particular allows good separation of the eyelashes during application.

"Multiple spikes" denotes spikes having at least two arms extending in divergent directions away from the core, these arms being connected, notably on the core, to one and the same base or having bases that meet or are close to one another.

"Bases close to one another" denotes bases, the spacing between which is less than their greatest dimension, measured perpendicularly to the axis of elongation of the corresponding arm.

The arms of a multiple spike may occupy the same axial position along the longitudinal axis of the core. The longitudinal axes of the arms of the multiple spike may be contained within one plane, perpendicular to the longitudinal axis of the core.

In the case of a double spike, the two arms of the spike may be symmetrical to each other with respect to a median plane of symmetry containing the longitudinal axis of the core, when this is rectilinear.

The double spikes may each have two arms, the bases of which meet or are at least 0.8 mm from each other.

The divergent arms of the double spike may form an angle of between 45 and 75°, better still between 55 and 65°, between one another.

The applicator may have at least one row of multiple spikes, preferably double spikes, which extends axially for example along substantially the entire length of the core.

The applicator may notably have two rows of multiple spikes, preferably double spikes, opposite one another. These two rows may be the only rows of multiple spikes on the applicator.

The applicator may have at least one row of single spikes, better still only two rows of single spikes, located opposite one another, between the rows of multiple spikes.

The single spikes may be rectilinear and extend radially from the longitudinal axis of the core.

The applicator may have only four rows of spikes, namely two rows of single spikes and two rows of multiple spikes, preferably double spikes.

The applicator may be flocked.

A further subject of the invention is a packaging and application device having an applicator according to the invention, as defined above, and a container containing the product to be applied.

A further subject of the invention is a method for making up the eyelashes and/or eyebrows, in which an applicator according to the invention is used to apply the makeup product.

A further subject of the invention is a method for manufacturing an applicator as defined above, comprising the steps of:

- taking hold of the assembly formed by the core and the spikes by way of the end piece,
- orienting the core by turning the end piece about the longitudinal axis of the core so as to make it easier to position the metal arms on the core,
- twisting two arms of a metal wire on the core in order to make the core deform in torsion about its longitudinal axis.

The method may comprise the steps of molding the core and the spikes and removing the molded part from the mold by taking hold of it by way of the end piece.

The method may comprise the step of bending a metal wire in two in order to form a pin which is inserted into the core. Preferably, the metal arms are inserted into the grooves of the corresponding core, by their free end being slid from the distal part of the core toward the end piece until the head of the pin is in contact with the distal end of the core.

The core may be oriented such that the ends of the metal arms end up, along the longitudinal axis of the core, next to the diametrically opposite grooves formed between the slots of the core.

Figure 2:
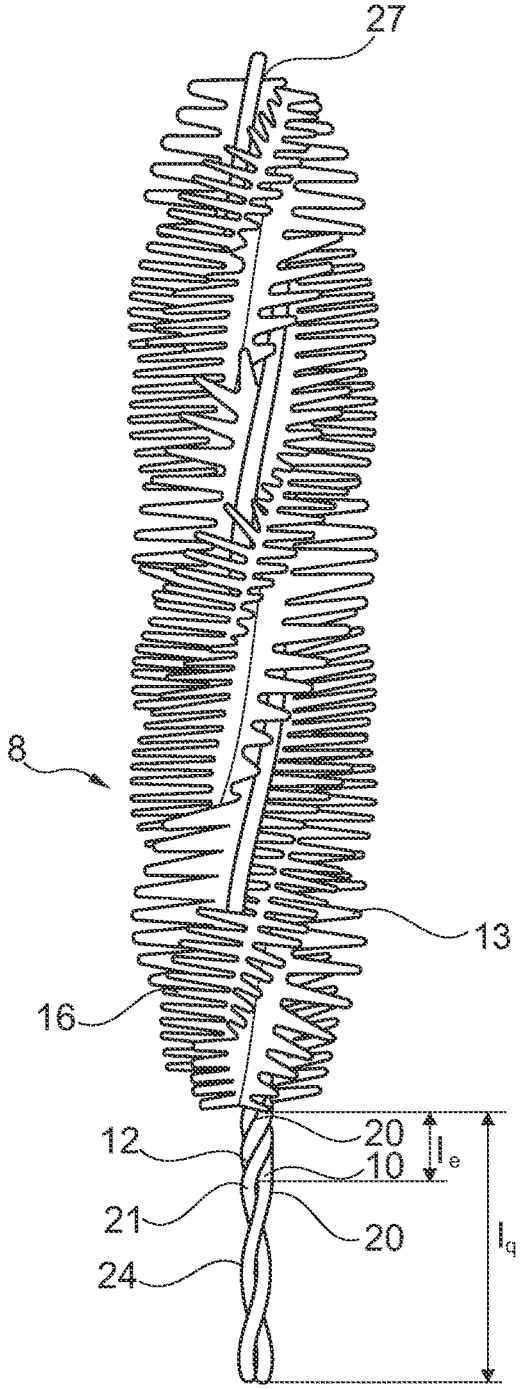
Figure 3:
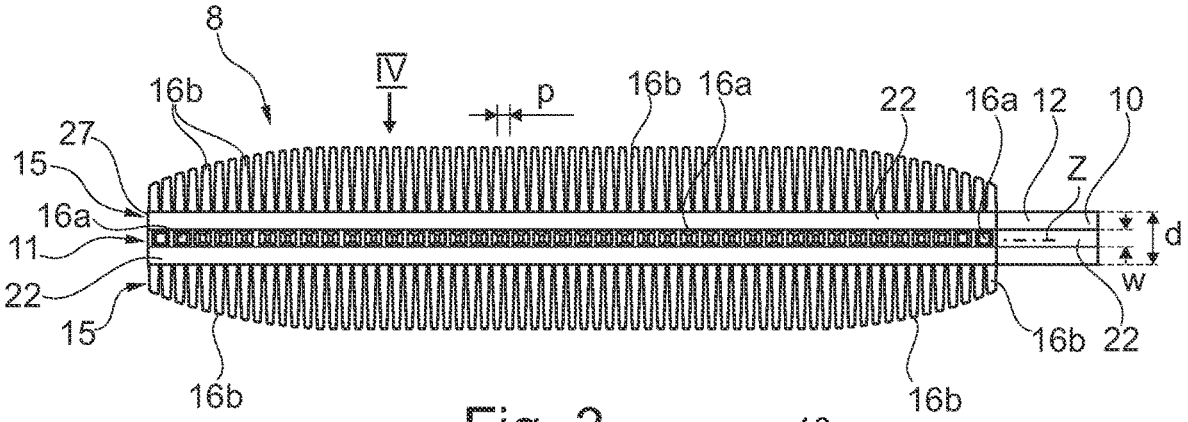
Figure 4:
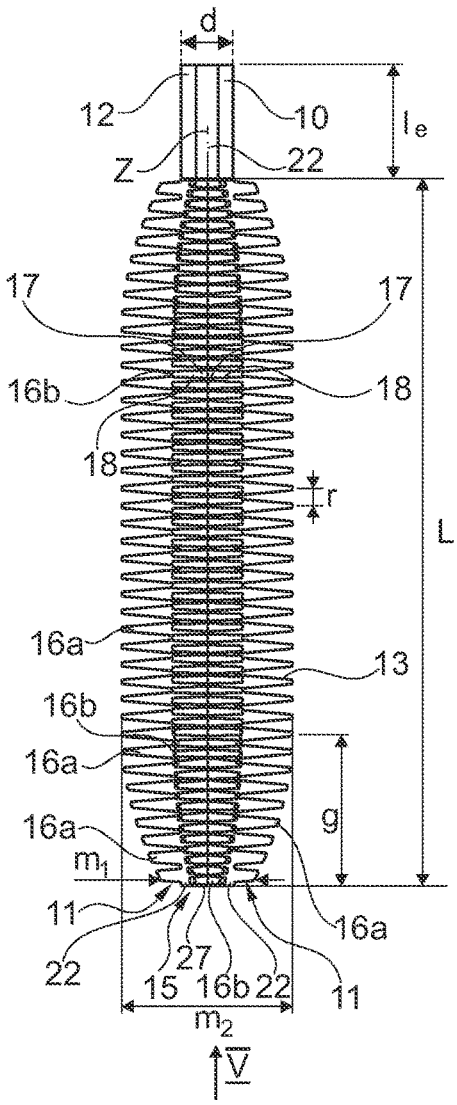
Figure 5:
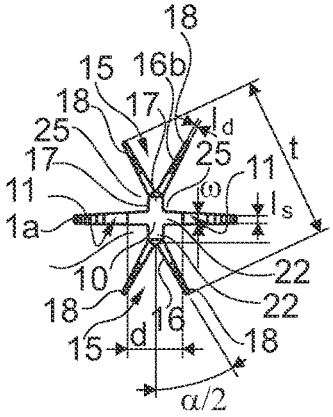
Figure 6A:
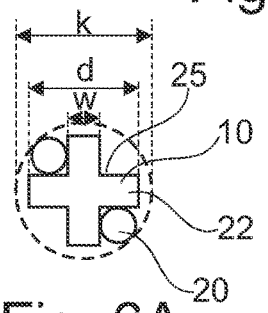
Figure 6B:
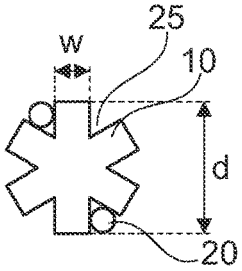
Figure 6C:
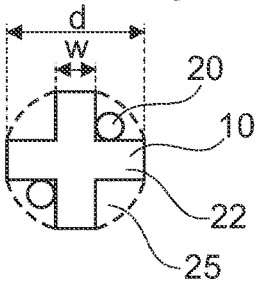

The invention may be better understood from reading the following detailed description of a nonlimiting implementation example thereof, and with reference to the attached drawing, in which:

FIG. 1 schematically shows, in longitudinal section, a packaging and application device according to the invention, FIG. 2 shows just the applicator member of the applicator from FIG. 1, FIG. 3 shows just the thermoplastic part of the applicator member, before the holder is placed thereon, FIG. 4 is a front view along the arrow IV in FIG. 3, FIG. 5 is a view along the arrow V in FIG. 4, and FIGS. 6A and 6C are variant cross sections through the applicator member at the end piece of the core.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also constituting a gripping member for the applicator 2.

The applicator 2 has a stem 7 of longitudinal axis Y, which is attached at its upper end to the closure cap 5 and at its lower end to an applicator member 8 according to the invention. Said applicator member 8 has a thermoplastic part, shown on its own in FIGS. 3 to 5, and a holder 21 having two metal arms 20, visible in FIG. 2, which are twisted on the thermoplastic part and between one another to form a tail 24 for fixing the applicator member 8 to the stem 7.

The thermoplastic part has a core 10 and spikes 16 that extend from the core 10 and all around the latter. The core 10 has a proximal end part that does not have spikes 16, forming an end piece 12.

The length of the end piece le is preferably between 1 mm and 7 mm.

Preferably, the ratio $l_e/l_q$ of the length $l_e$ of the end piece 12 to the length $l_q$ of the tail 24 is between 0.1 and 0.8.

The container 3 has a wiping member 6, for example inserted into the neck 4.

This wiping member 6, which may be any wiping member and which is made for example of elastomer, has, in the example in question, a lip designed to wipe the stem 7 and the applicator member 8 when the applicator 2 is withdrawn from the container 3. This wiping lip defines a wiping orifice 6*a* having a diameter adapted to that of the stem 7.

The wiping orifice 6*a* can be of circular shape, possibly with slits.

The diameter of the wiping orifice 6*a* is, for example, between 2.5 and 6 mm.

The wiping lip 6 may optionally have undulations, allowing the wiping orifice 6*a* to widen more easily when the applicator member 8 passes through.

In the example illustrated, the stem 7 has a circular cross section, but if the stem 7 has some other section, this does not depart from the scope of the present invention, it then being possible to fix the cap 5 on the container 3 in some other way than by screwing, if necessary.

Preferably, and as in the example in question, the longitudinal axis Y of the stem 7 is rectilinear and coincident with the longitudinal axis of the container 3 when the applicator 2 is in place thereon, but if the stem 7 is not rectilinear, forming for example an elbow, this does not depart from the scope of the present invention.

If need be, the stem 7 may have an annular narrowing in its portion that is positioned opposite the wiping lip, so as not to mechanically stress the latter unduly during storage.

The stem 7, to which the applicator member 8 is fixed, may also be at least partially, and in particular completely, flexible, notably in the vicinity of the applicator member.

In order to mould the thermoplastic part of the applicator member 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is possible notably to use the materials known under the trade names Teflon®, Hytrel®, Cariflex®, Alixine®, Santoprene®, Pebax® or Pollobas®, this list not being limiting.

Referring to FIGS. 2 to 5, it will be seen that the core 10 has, along its entire length, a cruciform cross section with four ribs 22 which are arranged in opposite pairs and meet at the centre of the core 10. The ribs 22 form grooves 25 between one another. As illustrated in FIG. 6A, at least two of the grooves 25 that are opposite with respect to the transverse axis Z of the core 10 receive the metal arms 20.

The core 10, notably the end piece 12, is twisted through at least two revolutions about its longitudinal axis along the entire length of the applicator member under the effect of the twist of the arms 20.

In a variant that is illustrated in FIG. 6B, the core 10 has more than four ribs 22, for example six ribs.

The core 10 can have axial symmetry about the axis Z, with for example a distance d between the tops of the opposite ribs 22 of between 2 and 3 mm, for example around 2.3 mm.

The width w of a rib 22 of the core 10 is for example between 0.5 and 0.8 mm, being for example around 0.6 mm.

The overall diameter k of the assembly formed by the end piece 12 provided with the arms 20 may be defined by these arms 20, as is illustrated in FIG. 6A.

In a variant that is illustrated in FIG. 6C, the arms 20 are inscribed entirely in the cross section of the end piece 12, and the overall diameter k of the assembly of end piece 12 and arms 20 is defined by the end piece 12.

Preferably, the overall diameter k of the assembly formed by the end piece 12 provided with the arms 20 is between 1.5 and 4 mm.

The spikes 16 extend from the core 10 in the form of mutually parallel longitudinal rows. Preferably, the rows of spikes 16 extend from the ribs 22 of the core 10, the grooves 25 not having spikes 16.

The height of the spikes 16 can decrease toward the free ends of the core 10.

The diameter of the circle circumscribed by opposite spikes 16 changes, for example, from $m_1$ to $m_2$, with $m_2>m_1$, as illustrated in FIG. 4, for example with $m_1$ being 4 mm and $m_2$ being 7 mm. The diameter $m_2$ is reached, for example, at a distance g from the end of the core of between 6 and 7 mm.

That part of the applicator member 8 that is made of plastic can have a generally symmetrical shape with respect to a median plane intersecting same halfway along, and perpendicular to the axis Z.

The total length L of the plastic part of the applicator member 8 is preferably between 15 and 33 mm, for example equal to approximately 27 mm.

In the example in question, the core 10 bears two rows 11 of single spikes 16*a*, these rows being diametrically opposite, and two other rows 15 of double spikes 16*b*. Each double spike 16*b* has two arms 18 which diverge from the longitudinal axis Z of the core 10 by an angle $\alpha$, where $\alpha/2$ is, for example, equal to 30°, as illustrated. The arms 18 of a single double spike 16*b* meet at the top of the corresponding rib 22 of the core 10. The bases 17 of these arms 18 occupy the same axial position on the longitudinal axis Z of the core, since they are arranged side by side on the rib 22 and meet one another.

La distance t between the ends of the diametrically opposite branches 18 of two double spikes 16*b* belonging respectively to the two opposite rows 15 of double spikes 16*b* is preferably between 5 and 10 mm, for example around 7 mm.

When the applicator member 8 is viewed along its longitudinal axis Z, the width $l_s$ of a single spike 16*a* at its free end is for example between 0.25 and 0.35 mm, notably around 0.3 mm, and the width $l_d$ of a double spike 16*b* is for example between 0.1 and 0.2 mm, being for example around 0.15 mm.

The distance p between the axes of two consecutive double spikes 16*a* within one row 15 of double spikes 16*b* is preferably between 0.3 and 1 mm, and is for example 0.45 mm.

The distance r between the axes of two consecutive single spikes 13 is preferably between 0.5 and 1.6 mm, and is for example about 0.75 mm.

In a variant, the spikes 16 may all be single spikes.

In order to produce the applicator member 8, the part thereof that is made of plastic, notably formed of the core 10 and the spikes 16, is first of all molded in the configuration illustrated in FIGS. 3 to 5.

Next, the molded part is taken hold of by way of the end piece and the holder 21 is placed on this part. The part is oriented such that the ends of the two arms 20 in the form of a U-shaped pin are brought next to two diametrically opposite 25 grooves 25 formed between the ribs 22 and are respectively fitted into said grooves until the head of the U-shaped pin is in contact with the distal end 27 of the core 10. Next, a torsion over more than two revolutions about the longitudinal axis Z is imparted on the core 10 by twisting the arms 20. The fact that the arms 20 are positioned in the grooves 25 makes it easily possibly to subject the core 10 to torsion without damaging the spikes 16. The shape shown in FIG. 2 is obtained, with the rows of spikes that each follow a substantially helical trajectory.

In order to use the device 1, the user unscrews the closure cap 5 and withdraws the applicator member 8 from the container 3.

Once the applicator member 8 has passed through the wiping member 6, a particular quantity of product P remains in the grooves 25 formed in the core 10 between the ribs 22, creating reservoirs of product along the entire length of the core 10 and on all sides, making it possible to load the eyelashes and/or eyebrows with product P in a satisfactory manner.

Of course, the invention is not limited to the exemplary embodiment which has just been described.

The spikes may have any shapes.

In a further variant, the applicator member 8 is able to vibrate, that is to say that vibrations are applied thereto during application, combing or picking up of the product P, for example as described in the application WO 2006/090343.

In a further variant, the applicator member 8 is able to rotate, that is to say is made to carry out a rotational movement about the longitudinal axis Z of the core 10, for example during application, combing or picking up of the product P.

In a further variant, the applicator member 8 is heated, that is to say has a heating element for heating the eyelashes and/or eyebrows, and/or the spikes 13 and 16 and/or the core 10 of the applicator member 8.

It is also possible for the applicator member 8 to be able to vibrate, to be able to rotate and to be heated, or only to be able to vibrate and to rotate, or only to be able to vibrate and to be heated, or only to be able to rotate and to be heated, or only to be able to vibrate or only to be able to rotate or only to be able to be heated.

The applicator member 8 may comprise any bactericidal agent such as silver salts, copper salts, preservatives and at least one preservative for the product P.

The core 10 and/or the spikes 13 and 16 may furthermore comprise particles, for example a filler, notably a compound which is magnetic, bacteriostatic or absorbs moisture, or a compound intended to produce roughness on the surface of the spikes 13 and 16 or to help the eyelashes and/or eyebrows slide on the spikes. At least one of the core 10 and a spike 13 or 16 may be flocked, undergo any heat treatment or mechanical treatment, and/or comprise particles, for example a filler, in order notably to improve the sliding of the applicator member on the eyelashes and/or eyebrows.

The invention claimed is:

1. An applicator for applying a cosmetic product to the eyelashes and/or eyebrows, having an applicator member having:

a core of thermoplastic material having a longitudinal axis, spikes of thermoplastic material extending from the core, a holder having two metal arms twisted around the core, the core being twisted through more than one revolution about its longitudinal axis from one end of the applicator member to the other under the effect of the twist of the metal arms of the holder, and the core having at least one end piece that extends along the longitudinal axis of the core and does not have spikes, the end piece being twisted, and the end piece having a plurality of ribs that define grooves between one another, the metal arms of the holder being received in these grooves, wherein the ratio ($l_e/l_g$) of the length of the end piece to the length of a tail of the applicator member formed by the proximal part thereof that does not have spikes is between 0.1 and 0.8.

2. The applicator as claimed in claim 1, wherein the end piece is a proximal end part of the core.

3. The applicator as claimed in claim 1, wherein the applicator has a stem in which the holder and the end piece are inserted.

4. The applicator as claimed in claim 3, wherein the end piece is inserted entirely in the stem.

5. The applicator as claimed in claim 1, wherein the end piece has a length ($l_e$) of between 1 and 7 mm.

6. The applicator as claimed in claim 1, wherein the holder extends along the entire length (L) of the core.

7. The applicator as claimed in claim 1, wherein the spikes are molded with the core.

8. The applicator as claimed in claim 1, wherein the core has a plurality of ribs that define grooves between one another, the metal arms of the holder being received in the grooves.

9. The applicator as claimed in claim 8, wherein the ribs extend along substantially the entire length (L) of the core.

10. The applicator as claimed in claim 8, wherein the ribs have a height greater than or equal to 0.8 mm.

11. The applicator as claimed in claim 8, wherein the cross section of the core is cruciform.

12. The applicator as claimed in claim 8, wherein the spikes extend from the ribs of the core.

13. The applicator as claimed in claim 8, wherein each of the metal arms extends along the entire length of a groove.

14. The applicator as claimed in claim 1, wherein the overall diameter (k) of the assembly formed by the end piece provided with the metal arms is defined by these arms situated opposite one another on the end piece.

15. The applicator as claimed in claim 1, wherein the arms are inscribed entirely in the cross section of the end piece, and the overall diameter (k) of the assembly of end piece and metal arms is defined by the end piece.

16. A method for manufacturing an applicator as claimed in claim 1, comprising the steps of:

taking hold of an assembly formed by the core and the spikes by way of the end piece, orienting the core by turning the end piece about the longitudinal axis of the core so as to make it easier to position the metal arms on the core, and twisting two arms of a metal wire on the core in order to make the core deform in torsion about its longitudinal axis.

17. The method as claimed in claim 16, wherein the core is oriented such that the ends of the metal arms end up, along the longitudinal axis of the core, next to diametrically opposite grooves formed between the ribs of the core.

* * * * *